US012410544B2

(12) United States Patent
Kulakowski et al.

(10) Patent No.: US 12,410,544 B2
(45) Date of Patent: Sep. 9, 2025

(54) TUNNEL WASHING MACHINE

(71) Applicant: PELLERIN MILNOR CORPORATION, Kenner, LA (US)

(72) Inventors: Christopher Mark Kulakowski, New Orleans, LA (US); Russell H. Poy, New Orleans, LA (US)

(73) Assignee: PELLERIN MILNOR CORPORATION, Kenner, LA (US)

( * ) Notice: Subject to any disclaimer, the term of this patent is extended or adjusted under 35 U.S.C. 154(b) by 479 days.

(21) Appl. No.: 17/869,283

(22) Filed: Jul. 20, 2022

(65) Prior Publication Data

US 2023/0032178 A1 Feb. 2, 2023

Related U.S. Application Data

(60) Provisional application No. 63/223,729, filed on Jul. 20, 2021.

(51) Int. Cl.
*D06F 31/00* (2006.01)
*D06F 37/02* (2006.01)

(52) U.S. Cl.
CPC ..... *D06F 31/005* (2013.01); *D06F 37/02* (2013.01)

(58) Field of Classification Search
CPC ..... D06F 31/005; D06F 37/02
See application file for complete search history.

(56) References Cited

U.S. PATENT DOCUMENTS 4,109,493 A * 8/1978 Hugenbruch ..... D06F 37/30 68/210
4,236,393 A 12/1980 Katzfey
(Continued)

FOREIGN PATENT DOCUMENTS

CN 101574696 1/2011
CN 104514129 4/2015

OTHER PUBLICATIONS

Machine translation of CN 101574696 A to Shi. (Year: 2009).*
International Search Report and Written Opinion for PCT International Application No. PCT/US2022/037700 (Nov. 4, 2022).

*Primary Examiner* — Joseph L. Perrin
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

The present invention discloses a tunnel washer apparatus. The apparatus provides a plurality of modules that include an intake module, a discharge module, and one or more modules in between the intake module and the discharge module. Multiple modules have a cylinder. Each cylinder has first and second cylinder ends. A scoop enables transfer of fabric articles to be washed from one cylinder to another cylinder. A first plate is connected to the scoop, wherein the first plate has a concave edge portion and a convex edge portion. The first plate preferably is welded to the first cylinder end with a first weld that extends along the convex edge portion. A second plate is connected to the scoop. The second plate has first and second convex edge portions. The second plate preferably is welded to the second cylinder end with a second weld that extends along one of the second plate convex edge portions. There is a first stress relieving gap in between the first cylinder end and the first weld. There is a second stress relieving gap in between the second cylinder end and the second weld. This arrangement enables the scoop and both plates to move together, thus providing a stress relieving annulus at scoop ends that reduces stress on or near one or more of the scoop to cylinder connections or welds below a threshold that otherwise results in fatigue/cracking.

36 Claims, 13 Drawing Sheets

(56) References Cited

U.S. PATENT DOCUMENTS

| | | | | |
|---|---|---|---|---|
| 4,363,090 | A | 12/1982 | Garcia | |
| 4,485,509 | A | 12/1984 | Pellerin et al. | |
| 4,522,046 | A | 6/1985 | Dreher | |
| 4,829,792 | A | 5/1989 | Keith | |
| 4,984,438 | A | 1/1991 | Batty | |
| 5,211,039 | A | 5/1993 | Pellerin | |
| 5,392,480 | A | 2/1995 | Ishihara et al. | |
| 5,454,237 | A | 10/1995 | Pellerin | |
| 5,564,292 | A | 10/1996 | Geiger | |
| 5,564,595 | A | 10/1996 | Minissian | |
| 6,238,516 | B1 | 5/2001 | Watson et al. | |
| 6,796,150 | B2 | 9/2004 | Bringewatt et al. | |
| 7,197,901 | B2 | 4/2007 | Monteiro et al. | |
| 7,971,302 | B2 | 7/2011 | Poy et al. | |
| 8,336,144 | B2 | 12/2012 | Poy et al. | |
| 8,370,981 | B2 | 2/2013 | Poy et al. | |
| 8,635,890 | B2 | 1/2014 | Jeong et al. | |
| 9,127,389 | B2 | 9/2015 | Poy et al. | |
| 9,200,398 | B2 | 12/2015 | Poy | |
| 9,580,854 | B2 | 2/2017 | Poy et al. | |
| 10,161,079 | B2 * | 12/2018 | Poy | D06L 1/16 |
| 10,450,688 | B2 | 10/2019 | Poy et al. | |
| 11,225,742 | B2 * | 1/2022 | Poy | D06F 31/005 |
| 2003/0110815 | A1 | 6/2003 | Poy | |
| 2013/0291314 | A1 | 11/2013 | Poy et al. | |
| 2014/0053343 | A1 * | 2/2014 | Poy | D06F 35/006 8/137 |
| 2017/0335499 | A1 | 11/2017 | Poy | |

* cited by examiner

TUNNEL WASHING MACHINE

CROSS-REFERENCE TO RELATED APPLICATIONS

This application claims benefit of U.S. Provisional Patent Application Ser. No. 63/223,729, filed 20 Jul. 2021, which is hereby incorporated herein by reference.

Priority of U.S. Provisional Patent Application Ser. No. 63/223,729, filed 20 Jul. 2021, which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to washing machines. More particularly, the present invention relates to an improved tunnel washing machine and method, the washing machine having multiple modules and wherein one or more of the modules have a specially configured scoop arrangement that enables the scoop to "virtually" float to lower stresses near welds that connect the scoop to the cylinder of a module. The highest mechanical stress is generated by the mass of the unit itself and the weight of linen (or fabric articles) at the transfer scoop connection to the entry and exit cylinder ends of a module. The present invention provides a uniquely configured stress relieving annulus at the scoop ends that allows the scoop to flex thereby reducing stress below a threshold that otherwise results in fatigue/cracking.

2. General Background

Patents have issued for large commercial type washing machines, typically referred to "tunnel washers" or "tunnel batch washers" or "continuous batch tunnel washers". Examples can be seen in U.S. Pat. Nos. 4,236,393; 9,127,389 (US Patent Application Publication No. 2010/0269267); and U.S. Pat. No. 9,580,854 (US Patent Application Publication No. 2013/0291314), each of which is hereby incorporated herein by reference. Such tunnel washers have multiple modules. In U.S. Pat. No. 4,236,393, each module is a cylinder or cylindrical casing having a peripheral wall with perforated areas. The '393 patent provides a continuous tunnel batch washer of modular construction with the number of modules varying depending upon installational requirements. Each module includes a drum rotatably supported and driven to oscillate in a predetermined manner during the washing cycle and to rotate unidirectionally during transfer of the load from one module to a succeeding module with a chute or trough arrangement extending between the modules for transferring the wash load from one module to a next successive module. The drum in each module is roller supported and chain driven from a common shaft with a plurality of independent motors driving the shaft by a belt drive with each module including a reduction gear driven from the shaft and having an output driving the sprocket chain for the oscillatable and rotatable drum. A programmed control device provides continuous control of each batch of articles being laundered as they progress to the successive module in the machine.

The following table lists possibly relevant patents (each hereby incorporated herein by reference) directed to washing machines including some tunnel washing machines.

TABLE

| U.S. Pat. No. | TITLE | ISSUE DATE MM/DD/YYYY |
|---|---|---|
| 10,450,688 | CONTINUOUS BATCH TUNNEL WASHER AND METHOD | 10/22/2019 |
| 9,580,854 | CONTINUOUS BATCH TUNNEL WASHER AND METHOD | 02/28/2017 |
| 9,200,398 | CONTINUOUS BATCH TUNNEL WASHER AND METHOD | 12/01/2015 |
| 9,127,389 | CONTINUOUS BATCH TUNNEL WASHER AND METHOD | 09/08/2015 |
| 8,635,890 | PEDESTAL WASHING MACHINE | 01/28/2014 |
| 8,370,981 | INTEGRATED CONTINUOUS BATCH TUNNEL WASHER | 02/12/2013 |
| 8,336,144 | CONTINUOUS BATCH TUNNEL WASHER AND METHOD | 12/25/2012 |
| 7,971,302 | INTEGRATED CONTINUOUS BATCH TUNNEL WASHER | 07/05/2011 |
| 7,197,901 | WASHING MACHINE | 04/03/2007 |
| 6,796,150 | INSTALLATION FOR THE WET-TREATMENT OF LAUNDRY, AND SEAL FOR SUCH AN INSTALLATION | 09/28/2004 |
| 6,238,516 | SYSTEM AND METHOD FOR CLEANING, PROCESSING, AND RECYCLING MATERIALS | 05/29/2001 |
| 5,564,595 | CHEMICAL DISPENSING SYSTEM | 10/15/1996 |
| 5,564,292 | WASHING MACHINE | 10/15/1996 |
| 5,454,237 | CONTINUOUS BATCH TYPE WASHING MACHINE | 10/03/1995 |
| 5,392,480 | WASHING METHOD BY A CONTINUOUS WASHING MACHINE | 02/28/1995 |

TABLE-continued

| U.S. Pat. No. | TITLE | ISSUE DATE MM/DD/YYYY |
|---|---|---|
| 5,211,039 | CONTINUOUS BATCH TYPE WASHING MACHINE | 05/18/1993 |
| 4,984,438 | PROCESSING OF DENIM GARMENTS | 01/15/1991 |
| 4,829,792 | DOUBLE DRUM BATCH WASHING MACHINE | 05/16/1989 |
| 4,522,046 | CONTINUOUS BATCH LAUNDRY SYSTEM | 06/11/1985 |
| 4,485,509 | CONTINUOUS BATCH TYPE WASHING MACHINE AND METHOD FOR OPERATING SAME | 12/04/1984 |
| 4,363,090 | PROCESS CONTROL METHOD AND APPARATUS | 12/07/1982 |
| 4,236,393 | CONTINUOUS TUNNEL BATCH WASHER | 12/02/1980 |

BRIEF SUMMARY OF THE INVENTION

The apparatus and method of the present invention improves the scoop portion of a tunnel washing machine and connection of the scoop to the cylinders of a tunnel washer. The continuous batch tunnel washer of the present invention has an interior, an intake, a discharge, and a plurality of modules that segment the interior. Fabric articles (e.g., linen) are moved from the intake to the discharge and through the modules in sequence.

The highest mechanical stress is generated by the linen(s) or fabric article(s) and the internal force of the cylinder assembly transfer scoop connection to the entry and exit cylinder ends of the module of a tunnel washing machine. The present invention features a unique stress relieving annulus at each of the scoop end connections thus allowing the scoop to flex and thereby reducing the stress below a threshold that results in fatigue cracking. The stress relieving annulus preferably results in about 6000 psi to achieve 10 million cycles, which is considered infinite life.

With the present invention, a specially configured scoop attaches at one end portion to a first curved, crescent shaped plate (or "moon") that preferably has a convex edge and a concave edge. Downstream of the first plate ("moon") is a second plate ("fish" shaped) preferably having two curved convex edges. A first weld preferably joins the first plate ("moon") along its convex edge to the cylinder portion of a module of the tunnel washer. A second weld preferably joins the second plate ("fish") along one of its convex edges to the cylinder at a downstream portion of the cylinder.

In one or more preferred embodiments, a specially configured scoop attaches at one end portion to a first curved, crescent shaped plate (or "moon") that preferably has a convex edge and a concave edge. Downstream of the first plate ("moon") is a second plate ("fish" shaped) preferably having two curved convex edges. A first connection preferably joins the first plate ("moon") along its convex edge to the cylinder portion of a module of the tunnel washer. A second connection preferably joins the second plate ("fish") along one of its convex edges to the cylinder at a downstream portion of the cylinder. The first and second connections can be joints, e.g., a weld or welded joint or weld connection.

In one or more preferred embodiments, the crescent shaped plate (or "moon") preferably has a convex edge, a concave edge and a notch. The notch is preferably a stress relieving portion.

In one or more preferred embodiments, the second plate ("fish" shaped) preferably has two curved convex edges and perforations.

In a preferred embodiment, a tunnel washer apparatus has a plurality of modules that include an intake module, a discharge module, and one or more modules in between the intake module and discharge module.

Each of the modules can have a cylinder with first and second cylinder ends and a central longitudinal axis.

A scoop preferably enables transfer of fabric articles to be processed from one cylinder to another cylinder. A first plate is preferably connected to the scoop. The first plate has a concave edge portion, a convex edge portion and a notch. The first plate is preferably welded to the first cylinder end with a first weld that extends along the convex edge portion. The first plate can have a notch at one end portion.

A second plate is preferably connected to the scoop. The second plate preferably has first and second convex edge portions. The second plate is preferably welded to the second cylinder end with a second weld that extends along one of the second plate convex edge portions.

A first stress relieving gap is preferably in between the first cylinder end and the first plate.

A second stress relieving gap is preferably in between the second cylinder end and the second plate.

The first weld can extend more than 180 degrees relative to the cylinder central longitudinal axis.

In a preferred embodiment, a first joint or connection or weld can extend more than 180 degrees relative to the cylinder central longitudinal axis.

The first plate can extend more than 180 degrees relative to the cylinder central longitudinal axis.

The cylinder has a central longitudinal axis and the first weld is preferably farther from the central longitudinal axis than the joint between the first plate and the scoop.

In a preferred embodiment, the cylinder has a central longitudinal axis and the second weld can be farther from the central longitudinal axis than the joint between the second plate and the scoop.

In a preferred embodiment, the second weld extends less than 180 degrees relative to the central longitudinal axis.

In a preferred embodiment, a second connection or joint or weld extends less than 180 degrees relative to the central longitudinal axis.

In a preferred embodiment, the second plate extends less than 180 degrees relative to the central longitudinal axis.

In a preferred embodiment, there are two cylinders joined with a connection that can include one or more annular plates, and wherein the first weld can be farther from the central longitudinal axis than one of the annular plates.

In a preferred embodiment, the scoop preferably connects to the first plate at a bend.

In a preferred embodiment, the scoop preferably connects to the second plate at a bend.

In a preferred embodiment, the first plate and the second plate can flex when the scoop is loaded by the unit mass and fabric articles and liquid and during scoop rotation.

In a preferred embodiment, the first plate and the second plate can simultaneously flex when the scoop is loaded by the unit mass and fabric articles and liquid and during scoop rotation.

In a preferred embodiment, two successive modules have two cylinders that are preferably connected together with an annular connecting portion having a first diameter. Each cylinder can have a cylinder periphery with a cylinder outer diameter that is preferably greater than the first diameter, each cylinder having upstream and downstream cylinder ends.

In a preferred embodiment, a scoop enables transfer of fabric articles to be washed from one said cylinder to another cylinder. A first plate is preferably connected to the scoop, the first plate having a concave edge portion and a convex edge portion. The first plate is preferably welded to the first cylinder end with a first weld at a convex edge portion.

In a preferred embodiment, a second plate is preferably connected to the scoop, the second plate having first and second convex edge portions. The second plate is preferably welded to the second cylinder end with a second weld at the second plate convex edge portion.

In a preferred embodiment, a first stress relieving gap can be positioned in between the first cylinder end and the first plate.

In a preferred embodiment, a second stress relieving gap can be positioned in between the second cylinder end and the second plate.

In a preferred embodiment, the first weld can extend along a majority of the first plate convex edge.

In a preferred embodiment, the cylinder preferably has a central longitudinal axis. The first weld is preferably farther from the central longitudinal axis than the annular connecting portion.

In a preferred embodiment, the cylinder preferably has a central longitudinal axis and the second weld is preferably farther from the central longitudinal axis than the annular connecting portion.

In a preferred embodiment, the second weld can extend less than 180 degrees relative to the central longitudinal axis.

In a preferred embodiment, the second plate can extend less than 180 degrees relative to the central longitudinal axis.

In a preferred embodiment, the annular connecting portion can include one or more annular plates. The first weld is preferably farther from the central longitudinal axis than one of the annular plates.

In a preferred embodiment, the first plate preferably connects to the scoop with a bend. In a preferred embodiment, the second plate preferably connects to the scoop with a bend.

In a preferred embodiment, the first plate and the second plate preferably simultaneously flex during washing or during scoop rotation about the central longitudinal axis.

In a preferred embodiment, the scoop preferably flexes longitudinally along the central axis during scoop rotation, wherein both first and second plates preferably move pivotally relative to the cylinder.

In a preferred embodiment, a method of relieving stress on a tunnel washer transfer scoop is provided, wherein the scoop can be attached to a tunnel washer drum. The washer preferably has multiple drums, some connected together with one or more annular rings.

In a preferred embodiment, the scoop has first and second plates and first and second welds, wherein the first plate is preferably an upstream plate and the second plate is preferably a downstream plate.

In a preferred embodiment, a first weld connects the first plate to a drum upstream end.

In a preferred embodiment, a second weld connects the second plate to a drum downstream end.

In a preferred embodiment, at least one of the welds is positioned in between the central longitudinal axis and drum periphery and outwardly of one of the annular plates.

In a preferred embodiment, each of the first and second plates pivots relative to the first or second weld.

In a preferred embodiment, the first plate has a convex edge portion, and a method includes welding the convex edge to the cylinder upstream end with a weld that extends along the convex edge.

In a preferred embodiment, the second plate has a convex edge portion, and a method includes welding the convex edge to the cylinder downstream end with a weld that extends along the convex edge.

In a preferred embodiment, the scoop can move longitudinally with the pivoting plates.

In a preferred embodiment, the first plate has a concave edge portion connecting the concave edge portion to the scoop.

In a preferred embodiment, the second plate has a convex edge portion and connecting the convex edge portion to the scoop.

In a preferred embodiment, each plate is connected to the scoop with a bend and can be pivoted in between the weld and a bend.

In a preferred embodiment, the rings preferably include an inner annular ring and an outer annular ring. The welds can be positioned in between the central longitudinal axis and the outer annular ring.

In a preferred embodiment, the first plate preferably flexes in between the concave and convex portions.

In a preferred embodiment, the second plate preferably flexes in between both convex portions.

In a preferred embodiment, the two (2) annular rings and the welds are preferably positioned closer to the central longitudinal axis than one ring and farther from the central longitudinal axis than the other ring.

In a preferred embodiment, the crescent shaped or first plate (or "moon") preferably has a convex edge, a concave edge and a notch.

In a preferred embodiment, the first plate can have first and second end portions, and wherein one end portion preferably includes a notch.

In a preferred embodiment, the second plate ("fish" shaped) can include perforations.

DETAILED DESCRIPTION OF THE INVENTION

Figure 7:
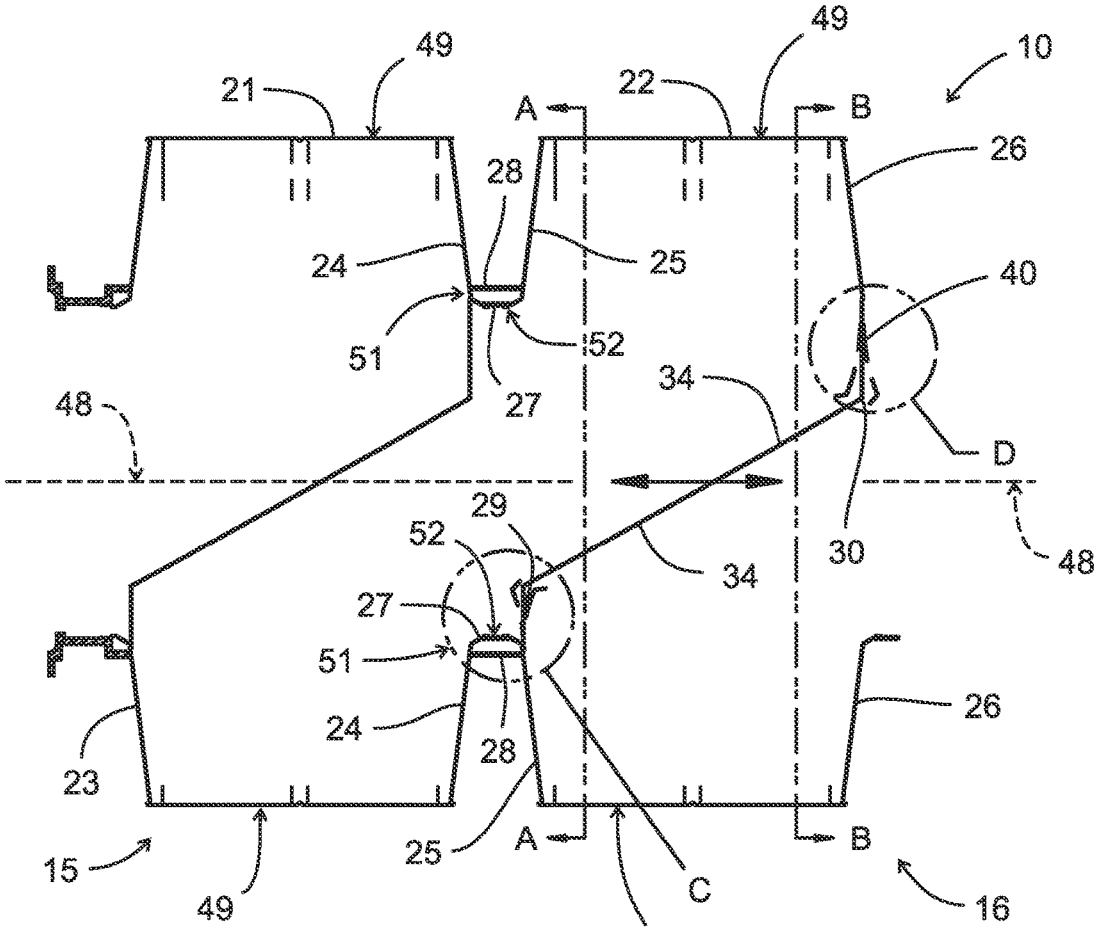
FIG. 7 is an elevation view of a preferred embodiment of the apparatus of the present invention.

FIGS. 1-25 show a preferred embodiment of the apparatus of the present invention designated generally by the numeral 10. Tunnel washer 10 preferably has an intake end portion 11, discharge end portion 12 and multiple modules 13-20 in between intake end portion 11 and discharge end portion 12. One or more of the modules 13-20 preferably has a scoop 34 that effects transfer of linens (or other fabric articles) from one module to another module. Each module 13-20 preferably has a cylinder or drum 21, 22. In FIG. 7, two modules are preferably welded together providing cylinders 21, 22 preferably joined with annular connecting portion 51 having inner most portion or inner surface 52.

Figure 1:
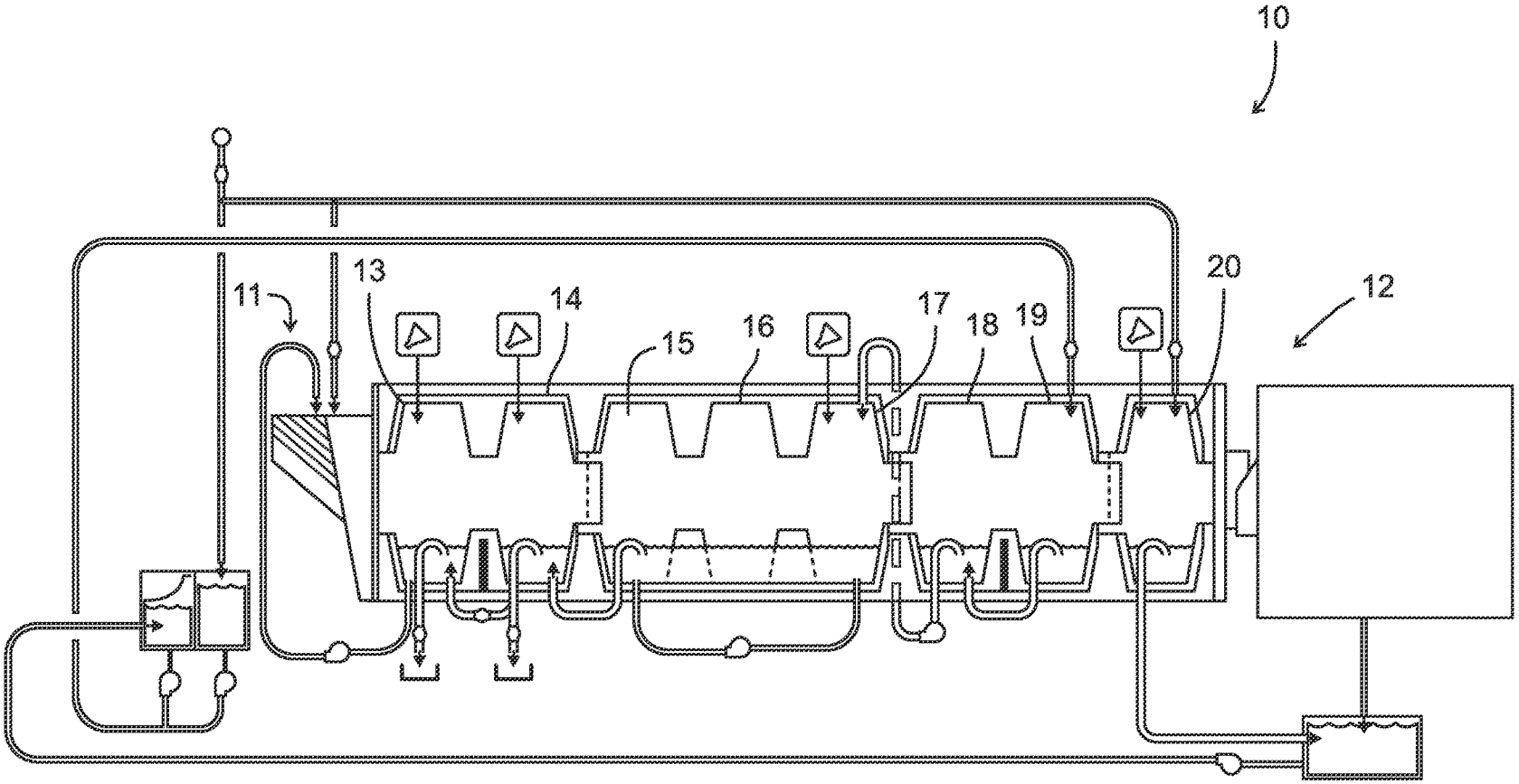
FIG. 1 is an elevation view of a tunnel washing machine that utilizes an improved scoop arrangement of the present invention.
Figure 2:
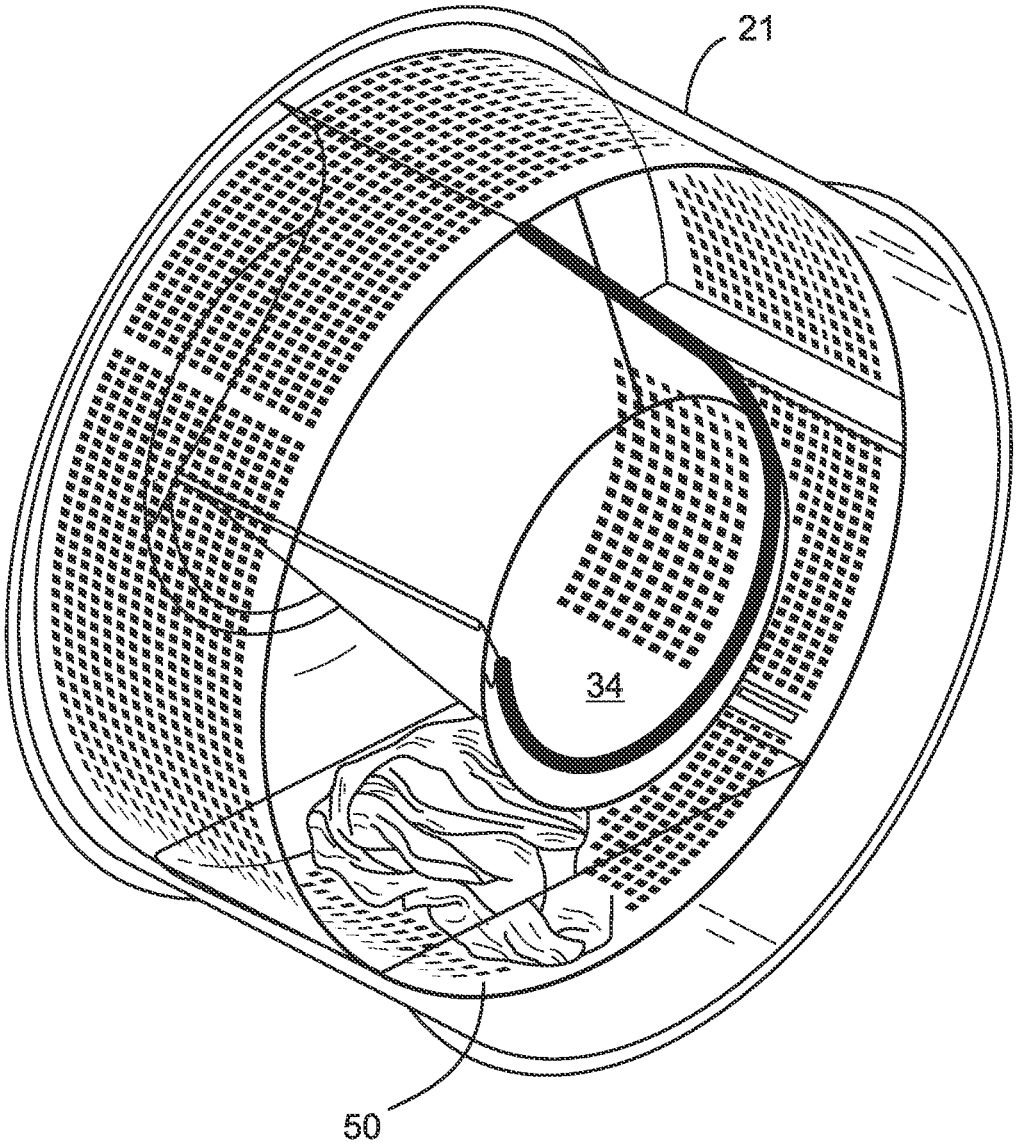
FIGS. 2-6 are sequential views that illustrate transfer of linen or other fabric articles from one module to another.
Figure 3:
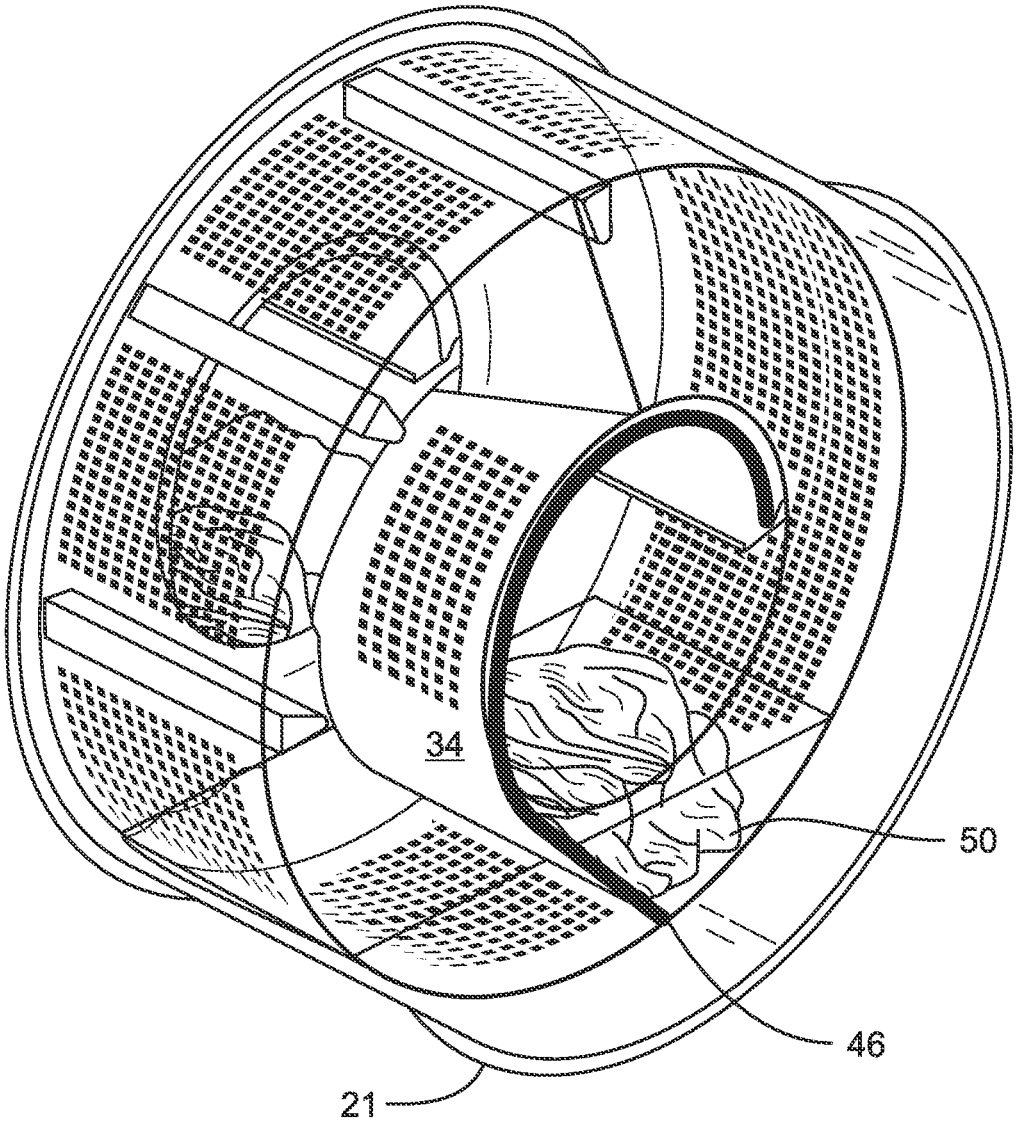
Figure 4:
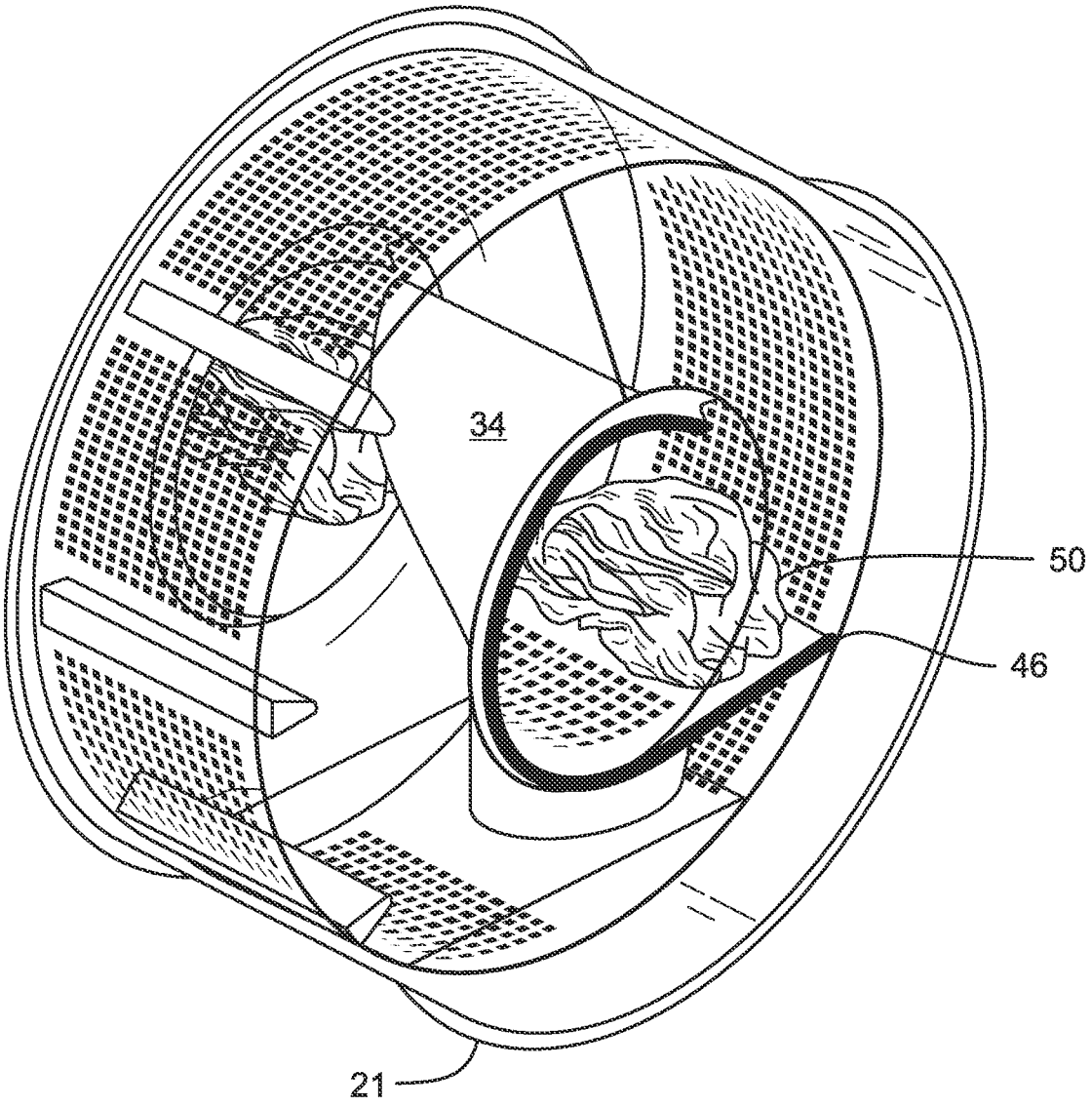
Figure 5:
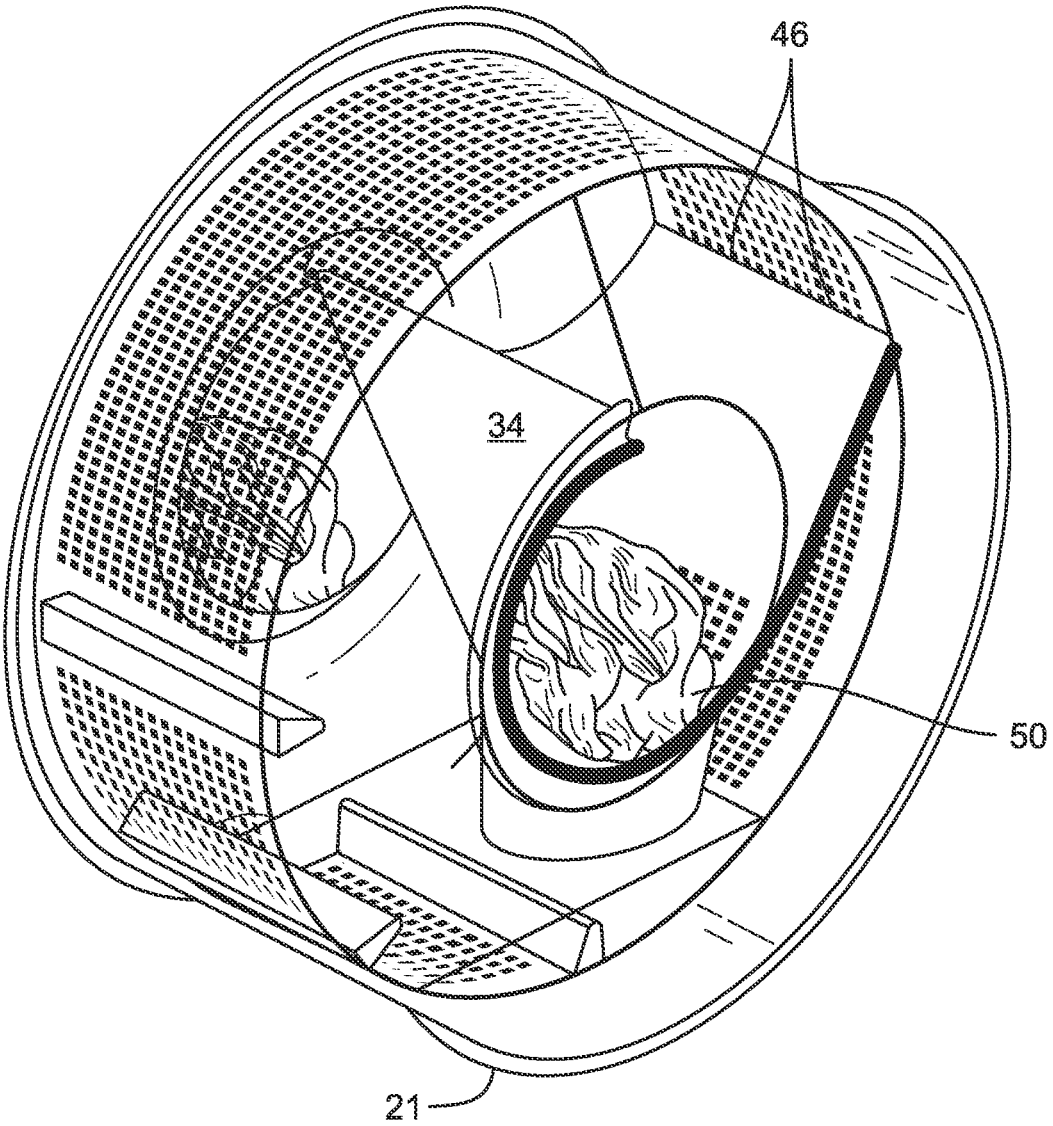
Figure 6:
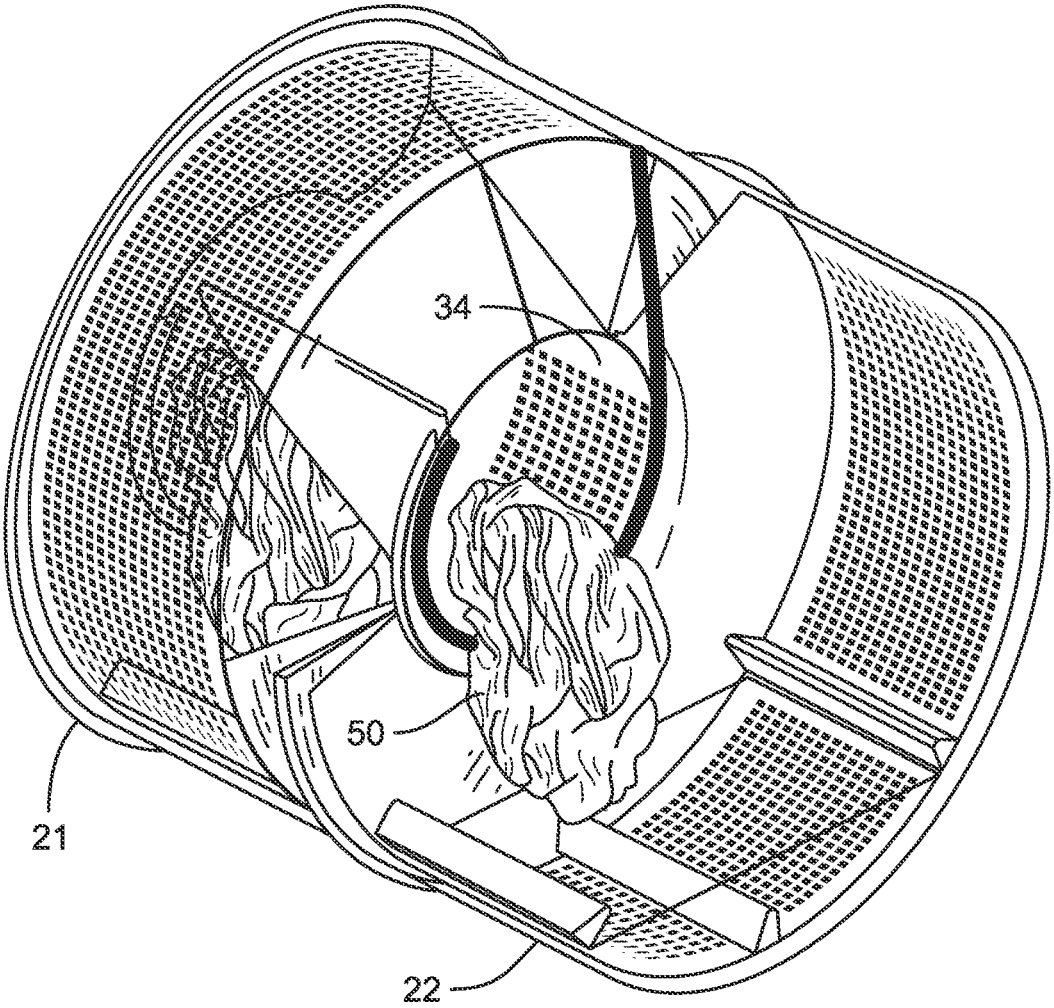

FIGS. 2-6 illustrate transfer of linen or fabric articles 50 from one cylinder 21 to the next cylinder 22. In FIG. 2, the linen 50 is in a lower washing position where the drum 21 preferably rotates a partial distance clockwise, then counterclockwise such as between about four o'clock and eight o'clock positions. After a timed washing, the cylinders 21, 22 rotate 360 degrees. Edge 46 of scoop 34 preferably grabs the linen (or fabric articles) 50 (see FIG. 3) and lifts the linen or fabric articles 50 upwardly (see FIGS. 4-5). The scoop 34 preferably then dumps the linen 50 into the next sequential cylinder 22 (see FIG. 6). Such a tunnel washer arrangement as seen in FIGS. 2-6 is known, shown and described in one or more of the above listed patents. Such a tunnel washer arrangement generates stress on the scoop that can result in metal fatigue/failure/cracking.

In FIGS. 7-23, cylinders 21, 22 each can have upstream and downstream cylinder ends. Cylinders 21, 22 share a central longitudinal axis 48. Cylinder 21 has upstream end 23 and downstream end 24. Cylinder 22 has upstream end 25 and downstream end 26. In FIG. 7, the cylinders 21, 22 are joined together with annular connecting portion 51. Annular connecting portion 51 can include two (2) annular plates or rings 27, 28 (see FIGS. 7, 10 and 13-14).

Figure 10:
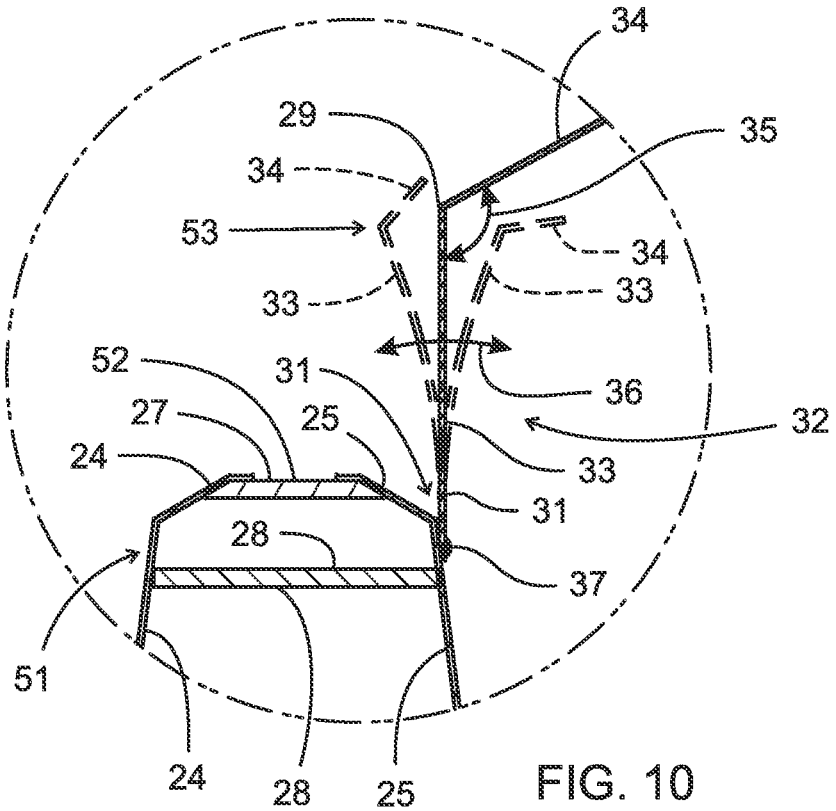
FIG. 10 is a fragmentary close up view of a preferred embodiment of the apparatus of the present invention identified as C in FIG. 7.
Figure 24:
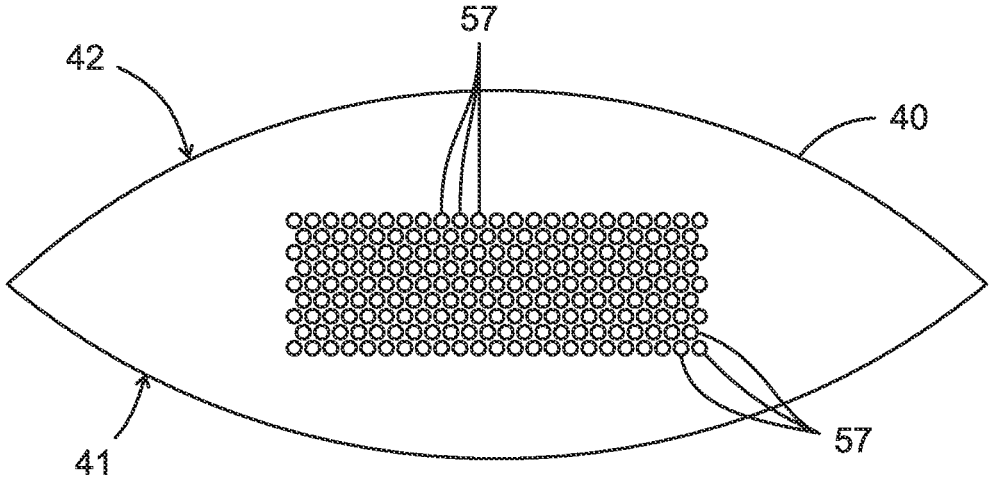
FIG. 24 is a fragmentary view of another preferred embodiment of the apparatus of the present invention showing a second plate or "fish"
Figure 25:
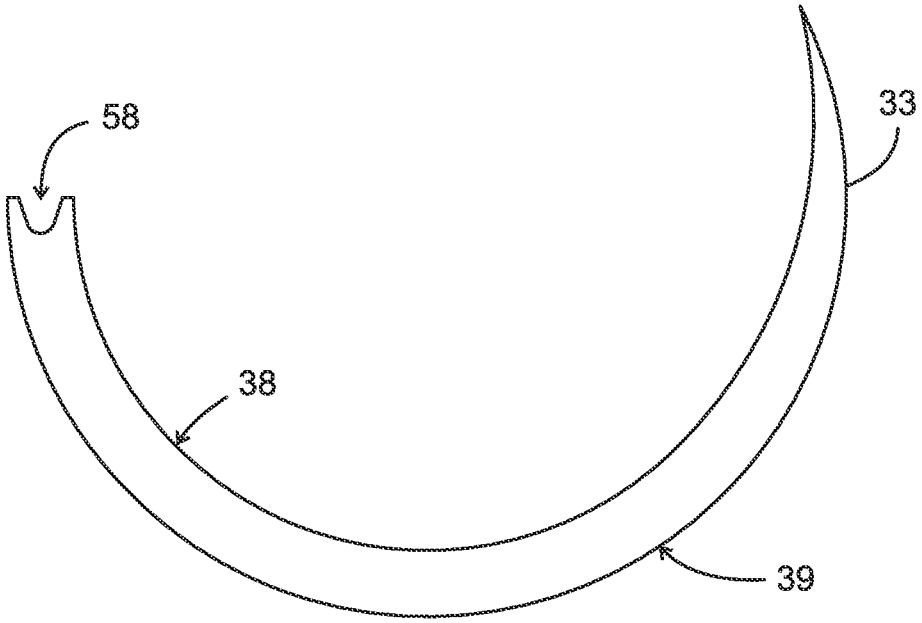
FIG. 25 is a fragmentary view of a preferred embodiment of the apparatus of the present invention showing a first plate or "moon".

Scoop 34 is preferably connected (e.g., at a bend 29 with angle 35) at scoop upstream end portion 53 to a first plate 33 (see FIGS. 7 and 10). Angle 35 is preferably no less than 28 degrees, and most preferably an obtuse angle. Plate 33 is preferably a crescent or moon shaped plate (see FIGS. 8, 18-23 and 25). Plate 33 is sometimes referred to herein as moon 33. Plate 33 preferably has concave edge 38 and convex edge 39. Plate 33 preferably includes a notch 58 at one end portion as seen in FIG. 25. Notch 58 can be a stress relieving portion of plate 33. Scoop 34 is preferably connected (e.g., at a bend 30 with angle 55) at a scoop downstream end portion 54 to a second plate 40 that preferably has two (2) convex edges 41, 42 (see FIGS. 9, 11, 16 and 19-23). Angle 55 is preferably no less than 28 degrees, and most preferably an obtuse angle. Plate 40 can be said to have a fish shape and is sometimes referred to herein as fish 40. Plate 33 is preferably connected to scoop 34 at bend 29 (see FIG. 10). Plate 40 is preferably connected to scoop 34 at bend 30 (see FIG. 11). In an alternate embodiment, plate 40 can include perforations or holes 57 as seen in FIG. 24 to allow liquid to flow through. Plate 33 and plate 40 can be made of 304L, 316 or Duplex Stainless Steel. Use of the plates 33, 40 in the tunnel washer 10 preferably results in about 6000 psi to achieve 10 million cycles, which is considered infinite life.

Figure 8:
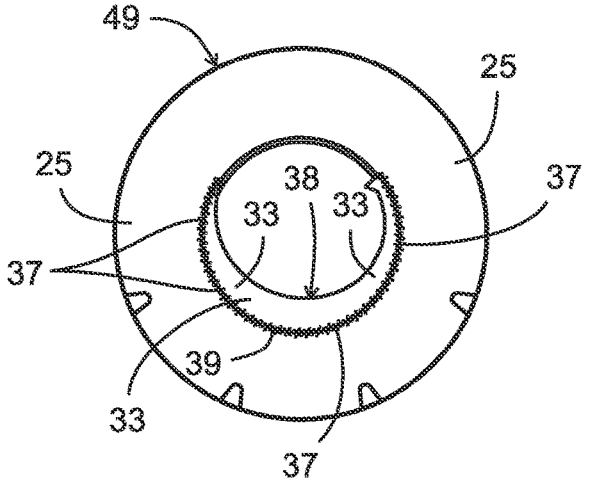
FIG. 8 is a sectional view taken along lines A-A of FIG. 7.
Figure 9:
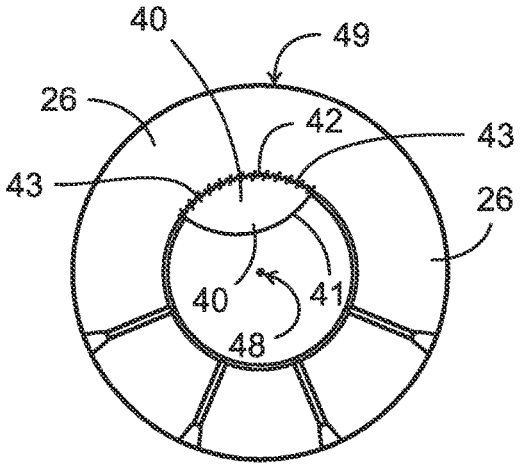
FIG. 9 is a sectional view taken along lines B-B of FIG. 7.

Plate 33 preferably connects to cylinder 22 (see FIGS. 7-8 and 10) with a weld 37 that joins edge 39 to cylinder 22 upstream end 25. Weld 37 can be positioned in between inner most portion/inner surface 52 of annular connecting portion 51 and cylinder periphery 49 as seen in FIGS. 7, 8 and 10. A pivoting joint 32 is thus formed as indicated schematically by arrow 36 in FIG. 10 and by the deflected positions (dotted lines) of first plate or moon 33 relative to connecting portion 51. As seen in FIG. 7, scoop 34 also preferably moves into the deflected positions illustrated by dotted lines in FIG. 10. A stress relieving aperture or gap 31 is preferably formed between first plate or moon 33 and cylinder end 25 (see FIG. 10). When such a two module sub-system is put under load (filled with linen 50 and fluid such as wash liquid/water), the scoop 34/moon 33/fish 40 areas are highly stressed. The present invention thus provides connections (see FIGS. 7-11) that preferably relieves stress at the scoop 34 and plate 33 (moon or crescent shaped plate) connection (see arrow 36). Similarly, with the connection at cylinder end 26, plate 40 (fish shaped) and scoop 34 preferably deflect as seen in dotted lines in FIG. 11 to relieve stress (see arrow 47).

Figure 11:
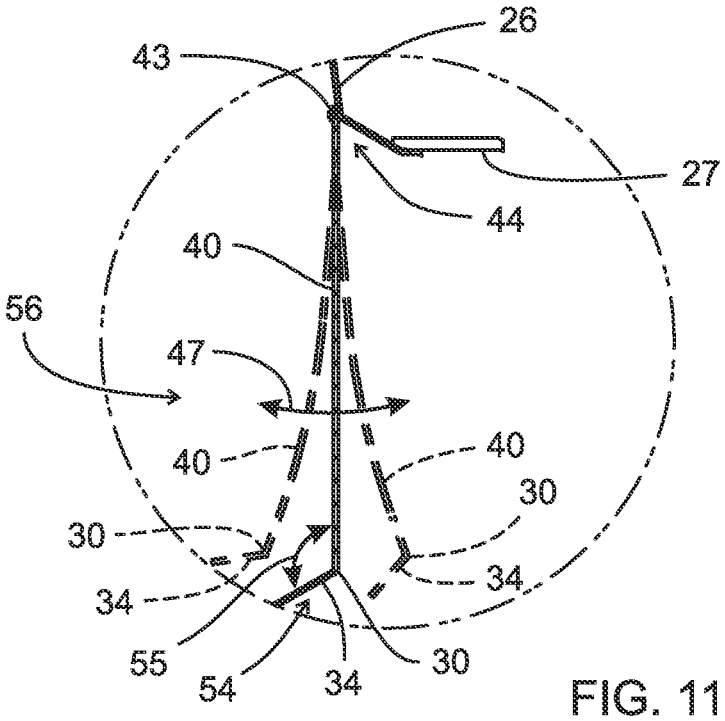
FIG. 11 is a fragmentary close up view of a preferred embodiment of the apparatus of the present invention identified as D in FIG. 7.
Figure 12:
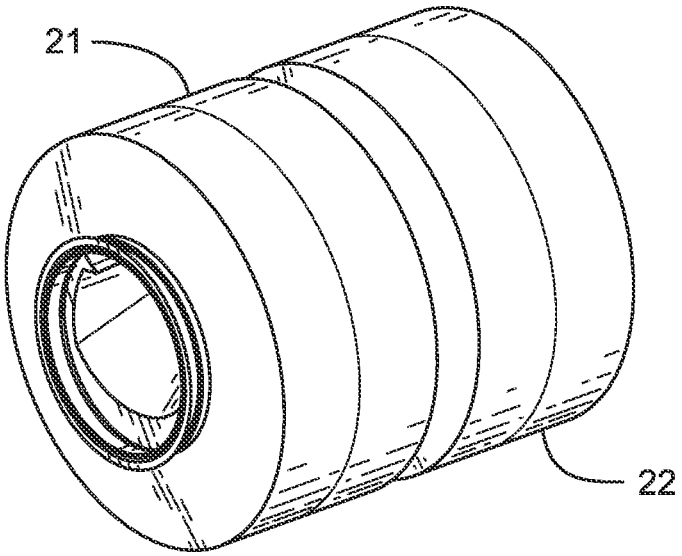
FIG. 12 is a fragmentary view of a preferred embodiment of the apparatus of the present invention showing two cylinders welded together.
Figure 13:
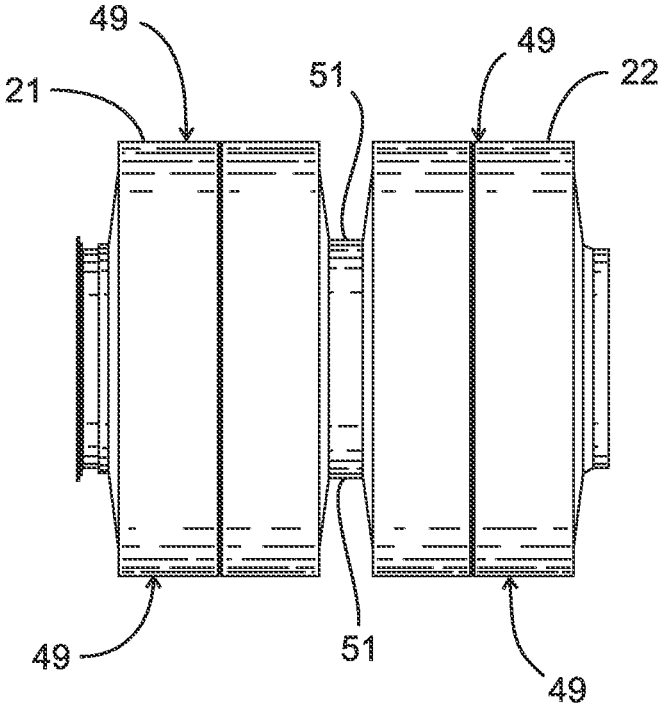
FIG. 13 is a fragmentary view of a preferred embodiment of the apparatus of the present invention showing two cylinders welded together.
Figure 14:
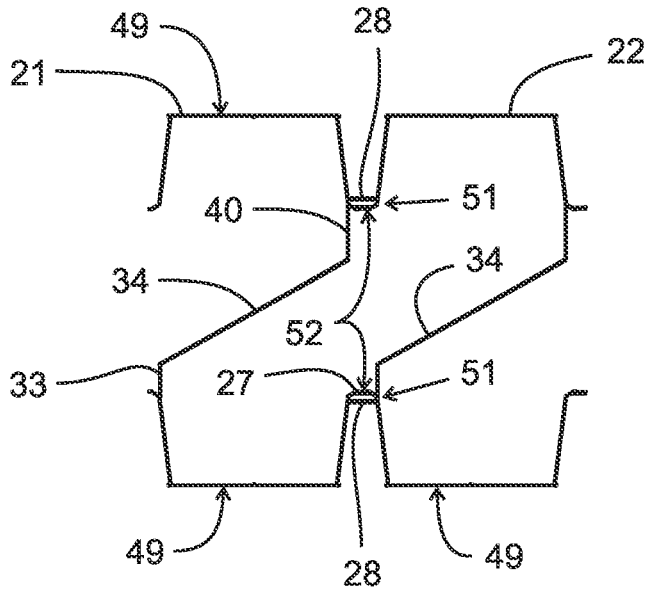
FIG. 14 is a fragmentary view of a preferred embodiment of the apparatus of the present invention showing two cylinders welded together.
Figure 15:
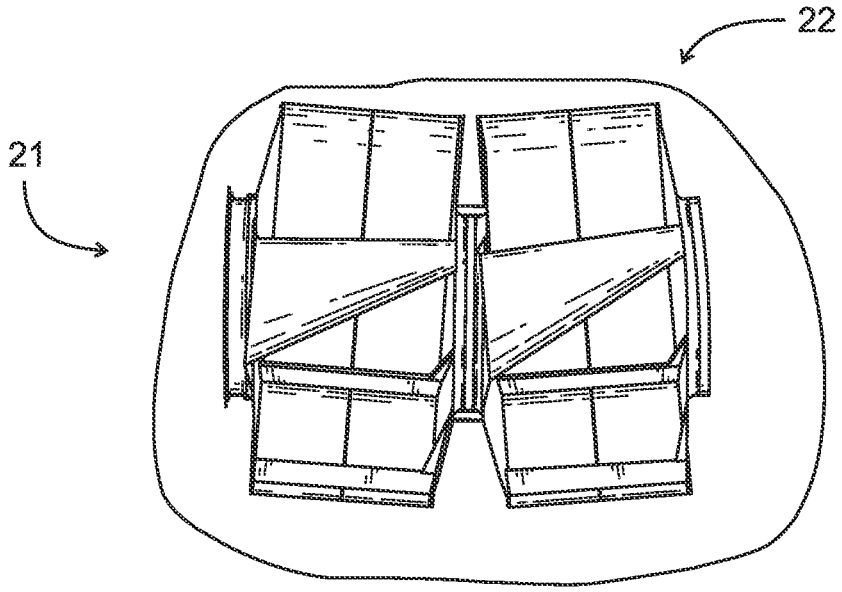
FIG. 15 is a fragmentary view of a preferred embodiment of the apparatus of the present invention showing two cylinders welded together.
Figure 16:
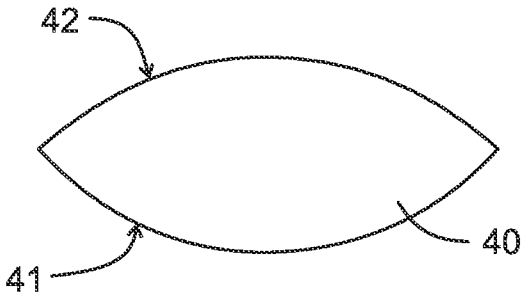
FIG. 16 is a fragmentary view of a preferred embodiment of the apparatus of the present invention showing a second plate or "fish"
Figure 17:
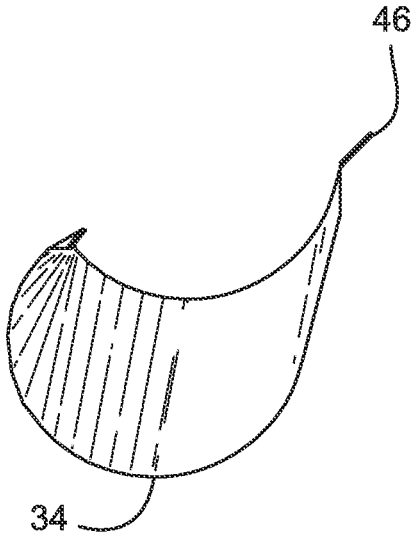
FIG. 17 is a fragmentary view of a preferred embodiment of the apparatus of the present invention showing a scoop.
Figure 18:
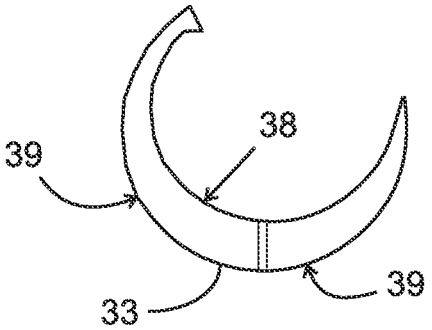
FIG. 18 is a fragmentary view of a preferred embodiment of the apparatus of the present invention showing a first plate or "moon"
Figure 19:
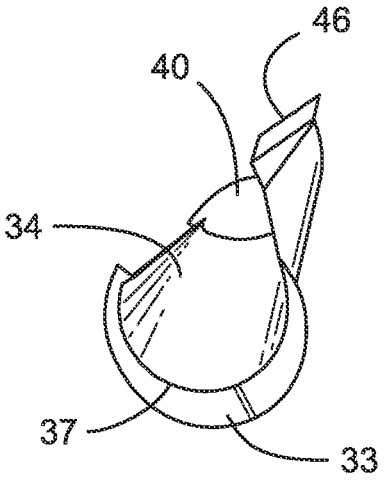
FIG. 19 is a fragmentary view of a preferred embodiment of the apparatus of the present invention showing a scoop, a first plate and a second plate.
Figure 20:
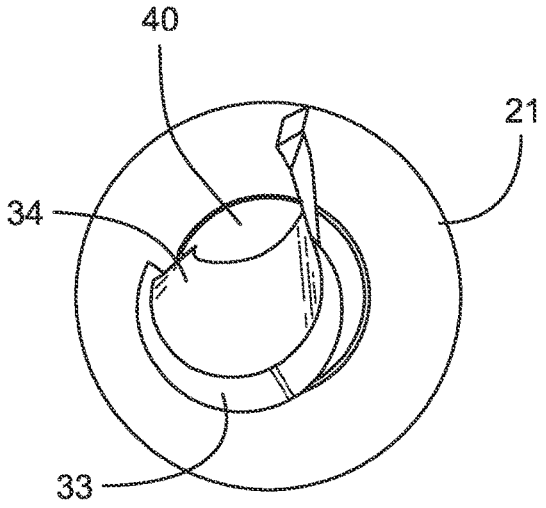
FIG. 20 is a fragmentary view of a preferred embodiment of the apparatus of the present invention showing a scoop, a first plate and a second plate.
Figure 21:
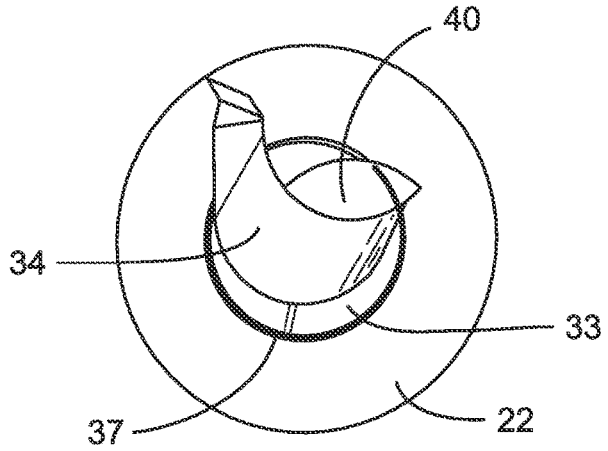
FIG. 21 is a fragmentary view of a preferred embodiment of the apparatus of the present invention showing a scoop, a first plate and a second plate.
Figure 22:
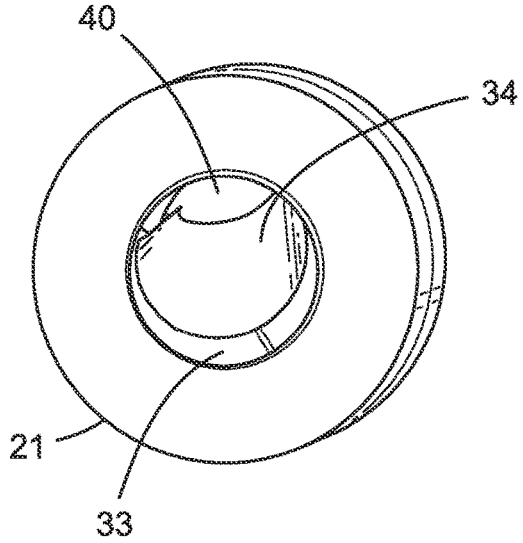
FIG. 22 is a fragmentary view of a preferred embodiment of the apparatus of the present invention showing a scoop, a first plate and a second plate.
Figure 23:
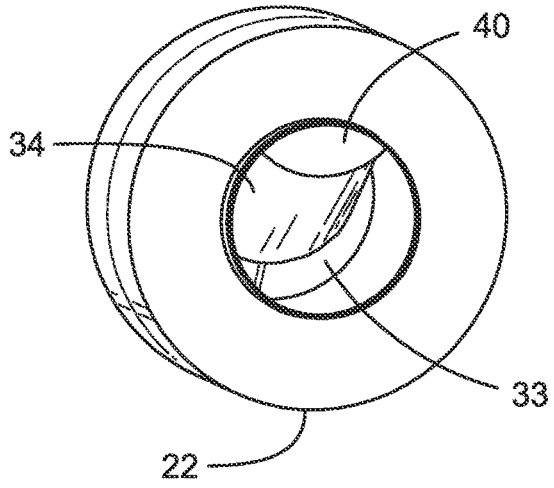
FIG. 23 is a fragmentary view of a preferred embodiment of the apparatus of the present invention showing a scoop, a first plate and a second plate.

The pivoting joint 56 of FIG. 11, plate 40 (fish shaped plate) preferably pivots about weld 43. Weld 43 preferably joins plate 40 to cylinder end 26, forming a stress relieving aperture or gap 44. In FIG. 11, plate 40 and scoop 34 preferably pivot about weld 43 (see arrow 47, FIG. 11).

The following is a list of parts and materials suitable for use in the present invention:

PARTS LIST:

| Parts Number | Description |
|---|---|
| 10 | tunnel washer apparatus |
| 11 | inlet end portion/intake end portion |
| 12 | discharge end portion |
| 13 | module |
| 14 | module |
| 15 | module |
| 16 | module |
| 17 | module |
| 18 | module |
| 19 | module |
| 20 | module |
| 21 | cylinder/drum |
| 22 | cylinder/drum |
| 23 | cylinder end/upstream end |
| 24 | cylinder end/downstream end |
| 25 | cylinder end/upstream end |
| 26 | cylinder end/downstream end |
| 27 | inner annular plate/ring |
| 28 | outer annular plate/ring |
| 29 | bend |
| 30 | bend |
| 31 | stress relieving aperture/gap |
| 32 | pivoting joint |
| 33 | crescent shaped plate/moon/first plate |
| 34 | scoop |
| 35 | angle |
| 36 | arrow |
| 37 | weld/moon weld/welded joint |
| 38 | concave edge |
| 39 | convex edge |
| 40 | plate/fish shaped member/fish/second plate |
| 41 | convex edge |
| 42 | convex edge |
| 43 | weld/welded joint/fish weld |
| 44 | stress relieving aperture/gap |
| 46 | scoop edge |
| 47 | arrow |
| 48 | central longitudinal axis |
| 49 | cylinder periphery |
| 50 | fabric articles/linen/clothing |
| 51 | annular connecting portion |
| 52 | inner most portion/inner surface |
| 53 | scoop upstream end portion |
| 54 | scoop downstream end portion |
| 55 | angle |
| 56 | pivoting joint |
| 57 | hole/perforation |
| 58 | notch |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A tunnel washer apparatus, comprising:

a) a plurality of modules that include an intake module, a discharge module, and one or more modules in between said intake module and said discharge module;

b) multiple of said modules having a cylinder with first and second cylinder ends;

c) a scoop that enables transfer of fabric articles to be washed from one said cylinder to another said cylinder;

d) a first plate connected to the scoop, said first plate having a concave edge portion and a convex edge portion, said first plate welded to the first cylinder end with a first weld that extends along said convex edge portion;

e) a second plate connected to the scoop, said second plate having first and second convex edge portions, said second plate welded to the second cylinder end with a second weld that extends along one of said second plate convex edge portions;

f) a first stress relieving gap positioned in between the first cylinder end and the first plate;

g) a second stress relieving gap positioned in between the second cylinder end and the second plate;

h) wherein said first plate is able to flex about said first weld at a first pivoting joint;

i) wherein said second plate is able to flex about said second weld at a second pivoting joint; and j) wherein said gaps enable deflection of said scoop and said plates reflective to a said cylinder end.

2. The tunnel washer apparatus of claim 1 wherein the cylinder has a central longitudinal axis and the first plate extends more than 180 degrees relative to said central longitudinal axis.

3. The tunnel washer apparatus of claim 1 wherein the cylinder has a central longitudinal axis and the first weld is farther from said central longitudinal axis than a joint between the first plate and the scoop.

4. The tunnel washer apparatus of claim 1 wherein the cylinder has a central longitudinal axis and the second weld is farther from said central longitudinal axis than a joint between the second plate and the scoop.

5. The tunnel washer apparatus of claim 1 wherein the cylinder has a central longitudinal axis and the second plate extends less than 180 degrees relative to said central longitudinal axis.

6. The tunnel washer apparatus of claim 1 wherein there are two cylinders joined with a connection that includes one or more annular plates, and wherein the first weld is farther from the cylinder central longitudinal axis than one of said annular plates.

7. The tunnel washer apparatus of claim 1 wherein the scoop connects to the first plate at a bend.

8. The tunnel washer apparatus of claim 1 wherein the second plate connects to the scoop at a bend.

9. The tunnel washer apparatus of claim 1 wherein the first plate and the second plate simultaneously flex when loaded with fabric articles and liquid during scoop rotation.

10. The tunnel washer apparatus of claim 1 wherein the first plate has first and second end portions, and wherein one end portion includes a notch.

11. The tunnel washer apparatus of claim 1 wherein the second plate includes perforations.

12. A tunnel washer apparatus, comprising:

a) a plurality of modules that include an intake module, a discharge module, and one or more modules in between said intake module and said discharge module;

b) two successive of said modules having two cylinders that are connected together with an annular connecting portion having a first diameter, each cylinder having a cylinder periphery with a cylinder outer diameter that is greater than said first diameter, each cylinder having upstream and downstream cylinder ends;

c) a scoop that enables transfer of fabric articles to be washed from one said cylinder to another said cylinder;

d) a first plate connected to the scoop, said first plate having a concave edge portion and a convex edge portion, said first plate welded to a first cylinder end with a first weld at said convex edge portion;

e) a second plate connected to the scoop, said second plate having first and second convex edge portions, said second plate welded to a second cylinder end with a second weld at a said second plate convex edge portion;

f) a first stress relieving gap that is positioned in between the first cylinder end and the first plate; and g) a second stress relieving gap that is positioned in between the second cylinder end and the second plate; and h) wherein said stress relieving gaps and said first and second plates enable the scoop to deflect relative to either of said cylinder ends.

13. The tunnel washer apparatus of claim 12 wherein the first weld extends along a majority of the first plate convex edge.

14. The tunnel washer apparatus of claim 12 wherein the cylinder has a central longitudinal axis and the first weld is farther from said central longitudinal axis than the annular connecting portion first diameter.

15. The tunnel washer apparatus of claim 12 wherein the cylinder has a central longitudinal axis and the second weld is farther from said central longitudinal axis than the annular connecting portion first diameter.

16. The tunnel washer apparatus of claim 12 wherein the cylinder has a central longitudinal axis and the second plate extends less than 180 degrees relative to said central longitudinal axis.

17. The tunnel washer apparatus of claim 12 wherein the cylinder has a central longitudinal axis and the annular connecting portion includes one or more annular plates, and wherein the first weld is farther from the central longitudinal axis than one of said annular plates.

18. The tunnel washer apparatus of claim 12 wherein the first plate connects to the scoop with a bend.

19. The tunnel washer apparatus of claim 12 wherein the second plate connects to the scoop with a bend.

20. The tunnel washer apparatus of claim 12 wherein the cylinder has a central longitudinal axis and the first plate and the second plate simultaneously flex during scoop rotation about said central longitudinal axis.

21. The tunnel washer apparatus of claim 20 wherein the scoop flexes longitudinally along said central axis during scoop rotation and wherein both first and second plates move pivotally relative to the cylinder.

22. A tunnel washer apparatus, comprising:

a) a plurality of modules that include an intake module, a discharge module, and one or more modules in between said intake module and said discharge module;

b) multiple of said modules having a cylinder with first and second cylinder ends;

c) a scoop that enables transfer of fabric articles to be washed from one said cylinder to another said cylinder;

d) a first plate connected to the scoop, said first plate having a concave edge portion and a convex edge portion, said first plate welded to the first cylinder end with a first weld that extends along said convex edge portion;

e) a second plate connected to the scoop, said second plate having first and second convex edge portions, said second plate welded to the second cylinder end with a second weld that extends along one of said second plate convex edge portions;

f) a first stress relieving gap positioned in between the first cylinder end and the first plate, such that the first plate and the scoop can deflect relative to the first cylinder end; and g) a second stress relieving gap positioned in between the second cylinder end and the second plate, such that the second plate and the scoop can deflect relative to the second cylinder end.

23. The tunnel washer apparatus of claim 22 wherein the cylinder has a central longitudinal axis and the first weld is farther from said central longitudinal axis than a joint between the first plate and the scoop.

24. The tunnel washer apparatus of claim 22 wherein the cylinder has a central longitudinal axis and the second weld is farther from said central longitudinal axis than a joint between the second plate and the scoop.

25. The tunnel washer apparatus of claim 22 wherein the cylinder has a central longitudinal axis and the second plate extends less than 180 degrees relative to said central longitudinal axis.

26. The tunnel washer apparatus of claim 22 wherein there are two cylinders joined with a connection that includes one or more annular plates, and wherein the first weld is farther from the cylinder central longitudinal axis than one of said annular plates.

27. The tunnel washer apparatus of claim 22 wherein the first plate has first and second end portions, and wherein one end portion includes a notch.

28. The tunnel washer apparatus of claim 22 wherein the second plate includes perforations.

29. The tunnel washer apparatus of claim 22, wherein two successive of said modules have two cylinders that are connected together with an annular connecting portion having a first diameter, each cylinder having a cylinder periphery with a cylinder outer diameter that is greater than said first diameter, each cylinder having upstream and downstream cylinder ends.

30. The tunnel washer apparatus of claim 29 wherein the cylinder has a central longitudinal axis and the first weld is farther from said central longitudinal axis than the annular connecting portion first diameter.

31. The tunnel washer apparatus of claim 29 wherein the cylinder has a central longitudinal axis and the second weld is farther from said central longitudinal axis than the annular connecting portion first diameter.

32. The tunnel washer apparatus of claim 29 wherein the cylinder has a central longitudinal axis and the annular connecting portion includes one or more annular plates, and wherein the first weld is farther from the central longitudinal axis than one of said annular plates.

33. The tunnel washer apparatus of claim 29 wherein the first plate connects to the scoop with a bend.

34. The tunnel washer apparatus of claim 29 wherein the second plate connects to the scoop with a bend.

35. The tunnel washer apparatus of claim 29 wherein the cylinder has a central longitudinal axis and the first plate and the second plate simultaneously flex during scoop rotation about said central longitudinal axis.

36. The tunnel washer apparatus of claim 35 wherein the scoop flexes longitudinally along said central axis during scoop rotation and wherein both first and second plates move pivotally relative to the cylinder.

* * * * *